US009085903B2

(12) United States Patent
Schlueter

(10) Patent No.: US 9,085,903 B2
(45) Date of Patent: Jul. 21, 2015

(54) PROFILE SYSTEM

(71) Applicant: Schlueter Systems L.P., Plattsburgh, NY (US)

(72) Inventor: Werner Schlueter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

(21) Appl. No.: 14/152,030

(22) Filed: Jan. 10, 2014

(65) Prior Publication Data

US 2014/0196384 A1 Jul. 17, 2014

(30) Foreign Application Priority Data

Jan. 11, 2013 (DE) ..... 20 2013 100 144 U

(51) Int. Cl.
*E04F 17/08* (2006.01)
*E04F 15/02* (2006.01)
*E04F 19/06* (2006.01)

(52) U.S. Cl.
CPC ..... *E04F 15/02005* (2013.01); *E04F 19/06* (2013.01)

(58) Field of Classification Search
CPC ..... E04F 15/02; E04F 15/02005; E04F 2201/0115; E04H 3/00; E04B 5/48; E04B 1/00; E04B 1/68; E04B 1/98; F21V 17/06; F21V 17/16; F21V 33/006; G02B 5/08; E04C 2/38; H02G 3/28; F21K 9/30
USPC ..... 52/220.5, 287.1, 288.1, 384, 716.1, 52/716.2, 716.6, 716.7, 718.01, 718.04, 52/34, 402, 388, 390–395, 459–462, 52/465–466, 470–471, 506.01, 506.05, 52/506.06, 506.07, 506.08, 506.09, 506.1, 52/173.1, 281, 282.1; 174/504, 507; 362/147 X, 249.02
See application file for complete search history.

(56) References Cited

U.S. PATENT DOCUMENTS 1,984,355 A 12/1934 Abbott
2,947,093 A * 8/1960 Masters ..... 434/421

(Continued)

FOREIGN PATENT DOCUMENTS

AT 511 325 A4 11/2012
DE 297 09 378 U1 7/1997

(Continued)

OTHER PUBLICATIONS

German Search Report dated Nov. 6, 2013 in German Application No. 20 2013 100 145.7 with English translation of relevant parts.

(Continued)

*Primary Examiner* — Brian Glessner
*Assistant Examiner* — Beth Stephan
(74) *Attorney, Agent, or Firm* — Collard & Roe, P.C.

(57) ABSTRACT

A profile system for finishing or defining a tile covering provided over a base includes at least one elongate profile that has a fastening arm and a profile section adjoining the latter which has a defining arm extending transversely, in particular at right angles, to the fastening arm and two side arms extending transversely, in particular at right angles to the free ends of the defining arm and arranged lying opposite one another, at least one illuminant that in the correct state is disposed in the receiving space defined by the substantially U-shaped profile section, and at least one elongate diffusion disc cover that can be secured to the profile.

15 Claims, 2 Drawing Sheets

(56) References Cited

U.S. PATENT DOCUMENTS

| | | | | |
|---|---|---|---|---|
| 3,667,177 | A * | 6/1972 | Biela | 52/278 |
| 5,140,506 | A | 8/1992 | Katz | |
| 5,165,780 | A | 11/1992 | Katz | |
| 5,243,799 | A * | 9/1993 | Schluter | 52/282.1 |
| 5,336,849 | A * | 8/1994 | Whitney | 174/72 C |
| 5,514,834 | A | 5/1996 | Zimmerman | |
| 5,732,747 | A * | 3/1998 | Holliday | 138/163 |
| 6,345,480 | B1 * | 2/2002 | Kemper et al. | 52/395 |
| 6,401,418 | B1 * | 6/2002 | Senn et al. | 52/506.01 |
| 6,591,575 | B2 * | 7/2003 | Benedettini | 52/716.1 |
| 6,727,434 | B2 | 4/2004 | Jadaud et al. | |
| 6,745,534 | B2 * | 6/2004 | Kornfalt | 52/468 |
| 6,911,597 | B2 * | 6/2005 | Seamans et al. | 174/507 |
| 6,972,637 | B2 | 12/2005 | Nation | |
| 6,990,776 | B2 * | 1/2006 | Berman | 52/311.1 |
| 7,060,893 | B1 * | 6/2006 | Villi | 174/507 |
| 7,388,163 | B2 * | 6/2008 | VanderVelde et al. | 174/480 |
| 2003/0029125 | A1 * | 2/2003 | Salice | 52/716.1 |
| 2005/0286247 | A1 * | 12/2005 | Peterson | 362/249 |
| 2006/0185295 | A1 * | 8/2006 | Gardner | 52/469 |
| 2008/0066419 | A1 * | 3/2008 | Stanchfield et al. | 52/716.1 |
| 2011/0058353 | A1 * | 3/2011 | Yang | 362/84 |
| 2011/0183153 | A1 * | 7/2011 | Schlueter | 428/600 |

FOREIGN PATENT DOCUMENTS

| | | | |
|---|---|---|---|
| DE | 297 11 074 | U1 | 7/1998 |
| DE | 202 12 950 | U1 | 12/2003 |
| DE | 20 2007 011 342 | U1 | 11/2007 |
| DE | 20 2009 001 162 | U1 | 4/2009 |
| DE | 10 2008 056 958 | A1 | 5/2010 |
| DE | 20 2010 005 347 | U1 | 8/2010 |
| DE | 20 2011 104 306 | U1 | 10/2011 |
| FR | 2 803 367 | A1 | 7/2001 |
| WO | 2011/151272 | A1 | 12/2011 |
| WO | 2012/056029 | A1 | 5/2012 |

OTHER PUBLICATIONS

German Search Report dated Dec. 19, 2013 in German Application No. 20 2013 100 141.4 with English translation of relevant parts.

* cited by examiner

PROFILE SYSTEM

CROSS REFERENCE TO RELATED APPLICATIONS

Applicant claims priority under 35 U.S.C. §119 of German Application No. 20 2013 100 144.9 filed Jan. 11, 2013, the disclosure of which is incorporated by reference.

BACKGROUND OF THE INVENTION

1. Field of the Invention

The present invention relates to a profile system for finishing or defining a slab covering provided over a base, for example in the form of tiles or the like.

2. Description of the Related Art

Profiles for finishing or defining a tile covering provided over a base, such as for example on a wall or on a floor, are known in a wide variety of different configurations in the prior art. They serve to protect the exposed edges of the tiles on the edge of a tile covering. Moreover, they are also often used as decorative strips. One example of this type of profile is described, for example, in DE-U-297 09 378.

SUMMARY OF THE INVENTION

Proceeding from this prior art it is an object of the present invention to extend the area of application of profiles of the type specified at the start.

In order to achieve this object, the present invention provides a profile system for finishing or defining a tile covering provided over a base, comprising at least one elongate profile that has a fastening arm and a profile section adjoining the latter which has a defining arm extending transversely, in particular at right angles, to the fastening arm, and two side arms extending transversely, in particular at right angles, to the free ends of the defining arm and arranged lying opposite one another, at least one illuminant, that in the correct state is disposed in the receiving space defined by the profile section, and at least one elongate diffusion disc cover that can be secured to the profile.

In the correctly arranged state the elongate profile is fastened to the base by the fastening arm. There are arranged over the top of the fastening arm tiles of the tile covering which are defined and protected by an outside of the profile section which is preferably substantially U-shaped. In addition to this conventional protective function the profile system according to the invention provides illumination which can be used, for example, as cove lighting for a ceiling, as plinth lighting for a base or the like. The illuminant is held in the profile section and is freely accessible after removing the diffusion disc cover so that, for example, repair work can be carried out without any problem. Consequently, the profile system according to the invention combines the functions of defining and protecting tile coverings with the function of providing visually attractive illumination.

According to one configuration of the present invention the profile is an extruded profile with a consistent cross-section. It is an advantage of extruded profiles that they are easy and inexpensive to produce.

Preferably, the profile is produced from aluminum or stainless steel. On the one hand, aluminum and stainless steel give the profile a visually attractive appearance. On the other hand, these materials are resistant to corrosion and accordingly are well suited for use in wet rooms, such as for example in bathrooms, in outdoor areas or the like.

According to one configuration of the present invention the fastening arm has through-holes arranged along its length, spaced apart from one another. An adhesive, such as for example a tile adhesive, used to secure the fastening arm to a base can pass through these through-holes, by means of which anchoring, and so securing of the fastening arm to the base is brought about.

According to an alternative configuration a fleece or a fabric is fastened to the back of the fastening arm. This fleece or fabric then serves as an adhesive base for the adhesive which is used to secure the fastening arm to a base.

Preferably, fastening means which co-operate with one another are provided on the diffusion disc cover and on the profile. Advantageously, the fastening means are made integrally with the profile and the diffusion disc cover, by means of which an inexpensive structure with a small number of individual components can be produced.

According to one configuration of the present invention the fastening means define a manually releaseable snap-on connection and in particular are provided in the form of protrusions and recesses that engage with one another. In this way one can produce a very simple fastening means structure.

According to one configuration of the present invention the diffusion disc cover has a base section and two side sections projecting from the latter and arranged lying opposite one another.

The first side section is preferably made to be longer than the second side section, in the correctly arranged state the illuminant being fastened to the inside of the region of the first side section which projects over the second side section. This design is advantageous in that due to the shorter second side section the illuminant disposed on the inside of the first side section is easily accessible, by means of which the manageability of the profile system is improved.

There is preferably provided in the region of the free end of the first side section an inwardly pointing protrusion which serves as a stop for the illuminant. This stop facilitates correct positioning of the illuminant and in addition contributes to stable fastening of the illuminant.

According to a first alternative of the present invention, in the correct state the base section of the diffusion disc cover terminates flush with the free ends of the side arms of the profile. In this first alternative light emitted by the first illumination means can accordingly only pass out of the profile in one direction.

According to a second alternative the second side section of the diffusion disc cover has in the region of its free end a region receding towards the first side section which is configured such that, in the correctly arranged state, the outer surface of the projecting region of the second side section terminates substantially flush with the outer surface of the adjacently arranged side arm of the profile. In this second alternative the light can accordingly also leave the profile in a second direction, as will be explained in more detail by means of the exemplary embodiment described below.

It should be made clear at this point that a profile system according to the present invention can have both a diffusion disc cover according to the first alternative and a diffusion disc cover of the second alternative.

The illuminant is preferably elongate in form, in particular in the form of a strip or a chain with a plurality of LEDs arranged over the latter.

According to one configuration of the present invention the illuminant is designed and arranged such that, in the correctly arranged state, light is irradiated towards the base section of the diffusion disc cover.

BRIEF DESCRIPTION OF THE DRAWINGS

Further features and advantages of the present invention become clear from the following description of an exemplary embodiment of a profile system according to the invention with reference to the attached drawings. These show as follows.

DETAILED DESCRIPTION OF PREFERRED EMBODIMENTS

Figure 1A:
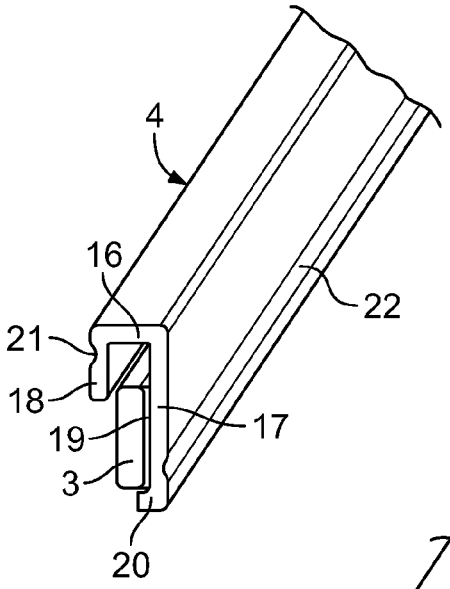
FIG. 1A a perspective view which shows a diffusion disc cover which is an individual component according to a first embodiment of the profile system according to the invention.
Figure 1B:
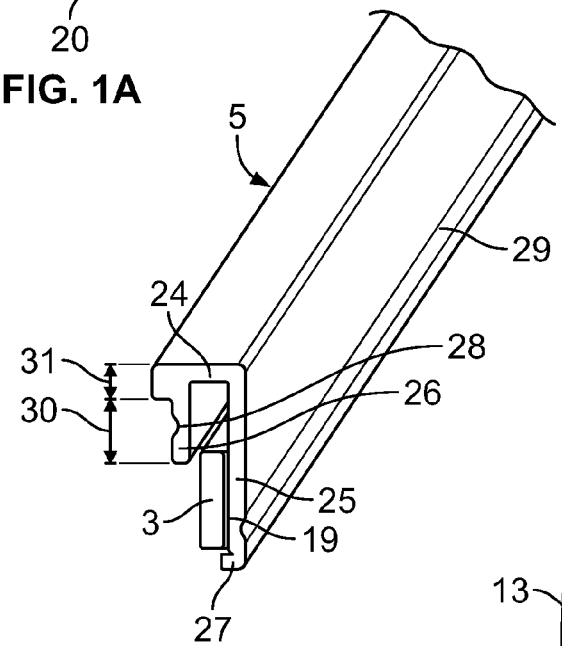
FIG. 1B a perspective view which shows a diffusion disc cover which is an individual component according to a second embodiment of the profile system according to the invention.
Figure 1C:
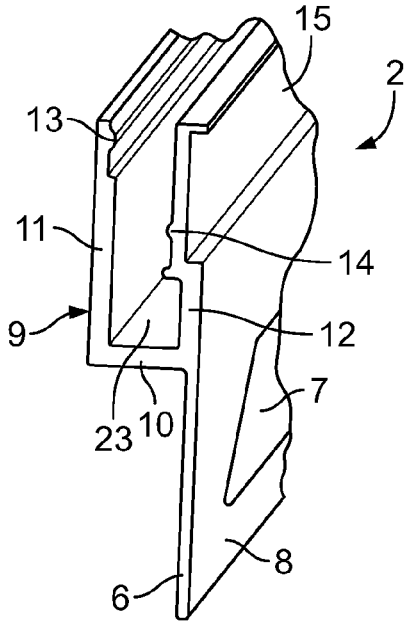
FIG. 1C a perspective view which shows a profile which can be fitted to either of the diffusion disc covers shown in FIGS. 1A and 1B.

The drawings show a profile system 1 according to one embodiment of the present invention that serves to finish or define a tile covering provided over a base and to provide illumination. The profile system 1 comprises as main components a profile 2 shown by itself in FIG. 1C and in a fitted state in FIGS. 2 and 3, an illuminant 3, a first type of diffusion disc cover 4 shown by itself in FIG. 1A and shown in FIG. 2 in a fitted state with the profile of FIG. 1C, and a second type of diffusion disc cover 5 shown by itself in FIG. 1B and shown in FIG. 3 in a fitted state with the profile of FIG. 1C.

The profile 2 is an extruded profile that is preferably produced from aluminum or stainless steel, other materials basically also being able to be used, such as for example plastic or the like. The profile 2 comprises a fastening arm 6 which in this instance is provided with through-holes 7 arranged along its length, spaced apart from one another. A viscous adhesive, such as for example a tile adhesive, used to fasten the profile 2 to a base can penetrate through these through-holes 7, by means of which anchoring is achieved in a known manner. Alternatively however, a fleece or fabric (not detailed) can also be fastened to the back 8 of the fastening arm 6, said fleece or fabric forming an adhesive base for an appropriate adhesive. The profile 2 further comprises a substantially U-shaped profile section 9 which is made integrally with the fastening arm 6. The U-shaped profile section 9 has a defining arm 10 extending at right angles to the fastening arm 6 and two side arms 11 and 12 extending at right angles to the free ends of the defining arm 10 and arranged lying opposite one another, the side arm 12 being arranged as an extension of the fastening arm 6. There are arranged on the insides of the side arms 11 and 12 inwardly projecting protrusions 13 and 14 which serve to releaseably hold the diffusion disc cover 4 or the diffusion disc cover 5, as will be described in more detail below. Moulded into the outside of the side arm 12 is a recess 15 which serves to hold excess adhesive when sticking the profile 2 to a base.

Figure 2:
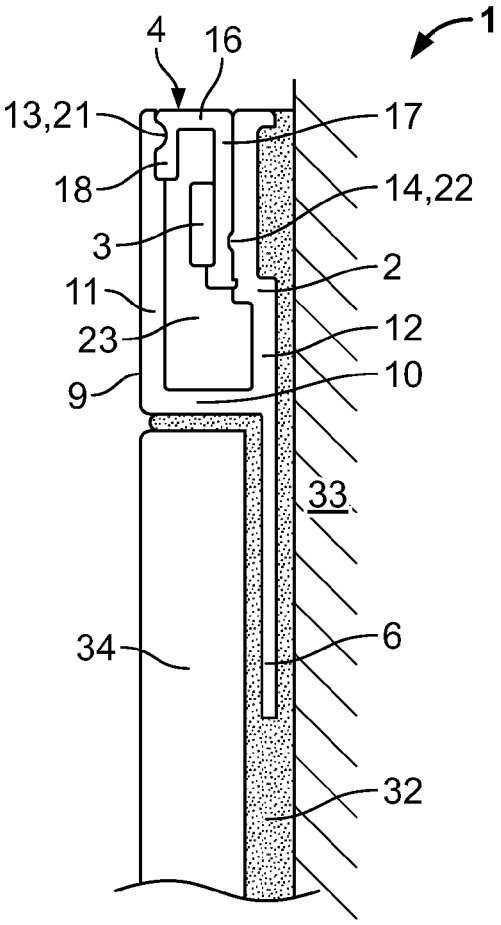
FIG. 2 a side view which shows the diffusion disc cover shown in FIG. 1A fitted in the profile of FIG. 10 to form a first embodiment of the profile system.

The diffusion disc cover 4 is produced from transparent plastic and comprises a base section 16 and two side sections 17 and 18 projecting from the latter at right angles and arranged lying opposite one another. The first side section 17 is made to be longer than the second side section 18 and on its inside in the region which projects over the second side section 18 holds the illuminant 3 which in this instance is secured by an adhesive strip 19. By virtue of the different lengths of the side sections 17 and 18 the illuminant 3 is easily accessible to a user. In the region of the free end of the first side section 17 there is an inwardly pointing protrusion 20 which serves as a stop for the illuminant 3. Each side section 17, 18 is provided on its outside with a groove-shaped recess 21, 22, in the correctly arranged state the groove-shaped recesses 21 and 22 co-operating with the elongate protrusions 13 and 14 of the profile 2 and defining a manually releaseable snap-on connection, as shown in FIG. 2. Accordingly, the diffusion disc cover 4 with the illuminant 3 held on the latter can be inserted from above between the side arms 11 and 12 of the profile 2 until the snap-on connection engages. If the diffusion disc cover 4 is inserted into the profile 2 the arrangement illustrated in FIG. 2 is produced in which the outside of the base section 16 of the diffusion disc cover terminates flush with the free ends of the side arms 11 and 12 of the profile 4. Accordingly, light emitted by the illuminant 3 can only leave the profile 2 in the direction of arrow A. In the correctly arranged state a duct 23 is left beneath the diffusion disc cover 4 which can be used, for example, for the laying of cables.

Figure 3:
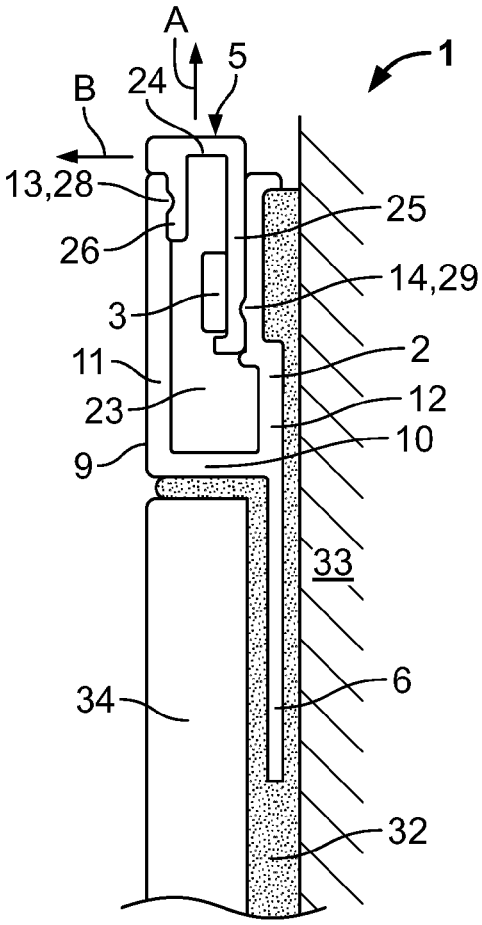
FIG. 3 a side view which shows the diffusion disc cover shown in FIG. 1B fitted in the profile of FIG. 10 to form a second embodiment of the profile system.

The diffusion disc cover 5 is also produced from transparent plastic and comprises a base section 24 and two side sections 25 and 26 projecting from the latter at right angles and arranged lying opposite one another. The first side section 25 is made to be longer than the second section 26, the illuminant 3 being fastened by an adhesive strip 19 to the inside of the region of the first side section 25 that projects over the second side section 26. By virtue of the different lengths of the side sections 25 and 26 the illuminant 3 is easily accessible to a user. In the region of the free end of the first side section 25 there is an inwardly pointing protrusion 27 which forms a stop for the illuminant 3. The side sections 25 and 26 are respectively provided on their outside with a groove-shaped recess 28, 29 which in turn co-operate with the elongate protrusions 13 and 14 of the profile 2 such as to produce a releaseable snap-on connection. The second side section 26 of the diffusion disc cover 5 has in the region of its free end a region 30 receding towards the first side section 25 and which is designed such that, in the correctly arranged state, the outer surface of the correspondingly projecting region 31 of the second side section 26 terminates substantially flush with the outer surface of the adjacently arranged side arm 11 of the profile 2, as shown in FIG. 3. Accordingly, light emitted by the illuminant 3 can leave the profile 2 in the direction of arrows A and B.

The illuminant 3 is an elongate strip with a plurality of LEDs arranged over the latter. The emission of light from the illuminant 3 is chosen such that in the correctly arranged state light is irradiated towards the base section 16, 24 of the corresponding diffusion disc cover 4, 5.

FIGS. 2 and 3 show the profile system 1 in the fitted state, according to FIG. 2 the diffusion disc cover 4 and according to FIG. 3 the diffusion disc cover 5 being held on the profile 2, by means of which different light effects are achieved. The profile 2 is respectively stuck to a base 33 using a tile adhesive 32. The hold between the profile 2 and the tile adhesive 32 is achieved by the tile adhesive 32 penetrating through the through-holes 7, by means of which corresponding anchoring takes place. The tiles 34 which are arranged adjacent to the profile 2 cover the fastening arm 6 of the profile 2 and are adjacent to the defining arm 10 which serves to protect the tile edge.

It is an advantage of the profile system 1 that it provides both a protective effect for the edges of the adjacently laid tiles as well as illumination which can be used, for example, as cove lighting for a ceiling, as plinth lighting for a base or the like. Moreover, by choosing appropriate diffusion disc covers 4 and 5 different light effects can be achieved. Moreover, the profile system 1 can be produced inexpensively and be handled easily.

| LIST OF REFERENCE NUMBERS | |
|---|---|
| 1 | profile system |
| 2 | profile |
| 3 | illuminant |
| 4 | diffusion disc cover |
| 5 | diffusion disc cover |
| 6 | fastening arm |
| 7 | through-hole |
| 8 | back |
| 9 | profile section |
| 10 | defining arm |
| 11 | side arm |
| 12 | side arm |
| 13 | protrusion |
| 14 | protrusion |
| 15 | recess |
| 16 | base section |
| 17 | side section |
| 18 | side section |
| 19 | adhesive strip |
| 20 | protrusion |
| 21 | groove-shaped recess |
| 22 | groove-shaped recess |
| 23 | duct |
| 24 | base section |
| 25 | side section |
| 26 | side section |
| 27 | protrusion |
| 28 | groove-shaped recess |
| 29 | groove-shaped recess |
| 30 | receding region |
| 31 | projecting region |
| 32 | tile adhesive |
| 33 | base |
| 34 | tile |
| A | arrow |
| B | arrow |

What is claimed is:

1. A profile system for finishing or defining a tile covering provided over a base, the profile system comprising at least one elongate profile that has a fastening arm and a substantially U-shaped profile section adjoining the fastening arm, wherein the profile section has a defining arm extending transversely to the fastening arm and connected to the fastening arm and first and second side arms extending transversely to first and second defining arm ends of the defining arm and arranged lying opposite one another, wherein the fastening arm is not the first side arm and is not the second side arm, at least one illuminant that in an installed state is disposed in a receiving space defined by the substantially U-shaped profile section, and at least one elongate diffusion disc cover capable of being secured to the profile to hold the at least one illuminant.

2. The profile system according to claim 1, wherein the profile is an extruded profile with a uniform cross-section.

3. The profile system according to claim 1, wherein the profile is produced from aluminum or stainless steel.

4. The profile system according to claim 1, wherein the fastening arm has through-holes arranged along its length, spaced apart from one another.

5. The profile system according to claim 1, wherein a fleece or a fabric is fastened to a back portion of the fastening arm.

6. The profile system according to claim 1, wherein first and second fastening elements which co-operate with one another are respectively provided on the diffusion disc cover and on the profile.

7. The profile system according to claim 6, wherein the fastening elements are made integrally with the profile and the diffusion disc cover.

8. The profile system according to claim 7, wherein the fastening elements define a manually releaseable snap-on connection.

9. The profile system according to claim 1, wherein the diffusion disc cover has a base section and first and second side sections projecting from the base section and arranged lying opposite one another.

10. The profile system according to claim 9, wherein the first side section is longer than the second side section and has a projecting region projecting from an inside of the first side section over the second side section, and wherein in the installed state the illuminant is fastened to the projecting region of the first side section.

11. The profile system according to claim 10, wherein there is provided in a region of a free end of the first side section an inwardly pointing protrusion which serves as a stop for the illuminant.

12. The profile system according to claim 9, wherein in the installed state the base section of the diffusion disc cover terminates flush with first and second free ends of the first and second side arms of the profile.

13. The profile system according to claim 9, wherein the second side section of the diffusion disc cover has in a region of a free end of the second side section a receding region receding towards the first side section which is configured such that, in the installed state, an outer surface of a projecting region of the second side section terminates substantially flush with the outer surface of the adjacently arranged first side arm of the profile.

14. The profile system according to claim 1, wherein the illuminant is elongate in form.

15. The profile system according to claim 1, wherein the illuminant is designed and arranged such that, in the installed state, light is irradiated towards the base section of the diffusion disc cover.

* * * * *